United States Patent [19]

Tyrén

[11] Patent Number: 4,944,222

[45] Date of Patent: Jul. 31, 1990

[54] PRINTER DEVICE WITH NOISE REDUCING IMPACT HAMMER

[75] Inventor: Carl H. Tyrén, Malmö , Sweden

[73] Assignee: Atech Aktiebolag, Götegorg, Sweden

[21] Appl. No.: 346,379

[22] Filed: Apr. 28, 1989

Related U.S. Application Data

[63] Continuation of Ser. No. 157,642, Feb. 18, 1988, abandoned, which is a continuation of Ser. No. 58,693, Jun. 3, 1987, abandoned.

[30] Foreign Application Priority Data

Jan. 30, 1984 [SE] Sweden ..... 8400439

[51] Int. Cl.[5] ..... B41J 9/00

[52] U.S. Cl. ..... 101/93.29; 400/124; 310/327; 310/328; 101/93.48

[58] Field of Search ..... 101/93.05, 93.29, 93.48; 400/124, 157.3, 157.1, 157.2; 310/326, 327, 328

[56] References Cited

U.S. PATENT DOCUMENTS 3,473,466 10/1969 Thayer .
3,614,486 10/1971 Smiley .
4,193,703 3/1980 Sakmann .
4,214,836 7/1980 Wang ..... 400/124
4,272,200 6/1981 Hehl .
4,353,298 10/1982 Baker et al. ..... 101/93.05
4,374,665 2/1983 Koon .
4,457,636 7/1984 Nusser .

FOREIGN PATENT DOCUMENTS 3137690 4/1983 Fed. Rep. of Germany .
765913 12/1978 U.S.S.R. .

OTHER PUBLICATIONS

IBM Technical Disclosure Bulletin, "Regulating Actuator Driver", vol. 24, No. 8, Jan. 1982, pp. 4143–4145.

*Primary Examiner*—E. H. Eickholt
*Attorney, Agent, or Firm*—Merchant, Gould, Smith, Edell, Welter & Schmidt

[57] ABSTRACT

Printer device in which a striking movement is imparted to a striking member (6) for transmitting a print (5) via an ink ribbon (3) to a paper (2) or the like bearing against an abutment (1). The striking movement of the striking member (6) is effected by means of a motion generator unit (8, 8A, 8B) of a giant magnetostrictive material consisting of an alloy between heavy earth metals and iron, cobalt or nickel, particularly an alloy between one of several of the substances terbium, dysprosium, samarium and iron. One end of the motion generator unit (8, 8A, 8B) is fixed to a supporting structure (9) and the opposite end thereof is fixed to said striking member (6). The motion generator unit (8, 8A, 8B) is surrounded by a magnetic coil (10, 10A, 10B) for applying a variable magnetic field to the motion generator unit, said magnetic field being variable in dependence of current supply to the coil. The current supply is controlled by using control means for controlling the supply of current to the coil in accordance with a predetermined programme in order to achieve a desired striking movement.

5 Claims, 2 Drawing Sheets

PRINTER DEVICE WITH NOISE REDUCING IMPACT HAMMER

This is a continuation, of application Ser. No. 157,642, filed Feb. 18, 1988 now abandoned which in turn was a continuation of application Ser. No. 085,693, filed June 3, 1987 and now abandoned.

The present invention relates to a printer device in which a striking movement is imparted to one or several striking elements for transmitting, via an ink ribbon, a print to a paper etc. which bears against an abutment.

Known printers of this kind include striking members which are electromagnetically accelerated into impact against an underlying paper etc. via an ink ribbon. In certain types of printers, so-called matrix-printers, the very striking movement is effected by means of a spring whereas the spring itself for every strike being stretched by means of an electromagnet. In other types of printers the case may be the reverse, i.e. the striking movement is effected by means of the electromagnet and the return of the striking member is effected by means of spring force.

One disadvantage with known printers is the unwanted high noice level obtained during the operation of the striking members. The noice partly consists of mechanical clatter from the interconnected, moveable parts of the striking mechanism, and partly of noice generated when the striking members hit the paper via the ink ribbon. Another considerable disadvantage with the known devices is the limited printing velocity obtained from the previously known devices.

One object of the present invention is to provide a device of the kind mentioned initially which renders possible a considerable decrease in disturbing noice from the printer, at the same time enabling a considerable increase with respect to the printing velocity. Another object of the invention is to provide a device of the kind mentioned initially in which the striking force and the velocity sequence of the striking member can be very carefully controlled during the entire striking sequence and which, due to its design results in decreased wear and reduced costs for manufacture and service.

The objects mentioned above are obtained by means of a design in accordance with the appended claims. The invention will de described in the following with reference to some schematic embodiments, illustrated in the appended figures which very schematically illustrate the application of the principal according to the invention.

Figure 1:
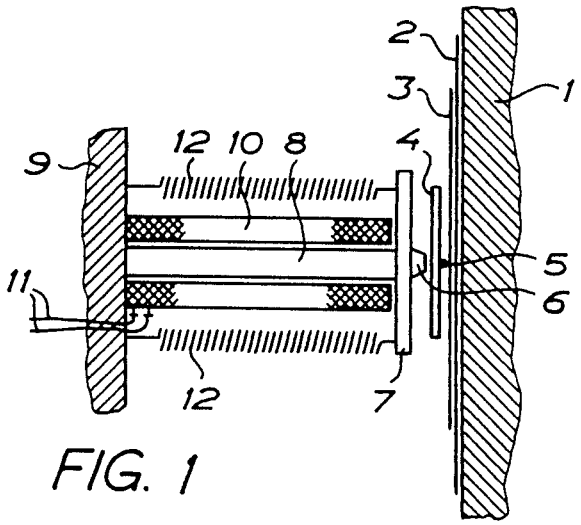

FIG. 1 very diagrammatically illustrates a printer device of printer hammer-type in which the motion generator unit acts directly in the striking direction.

Figure 2:
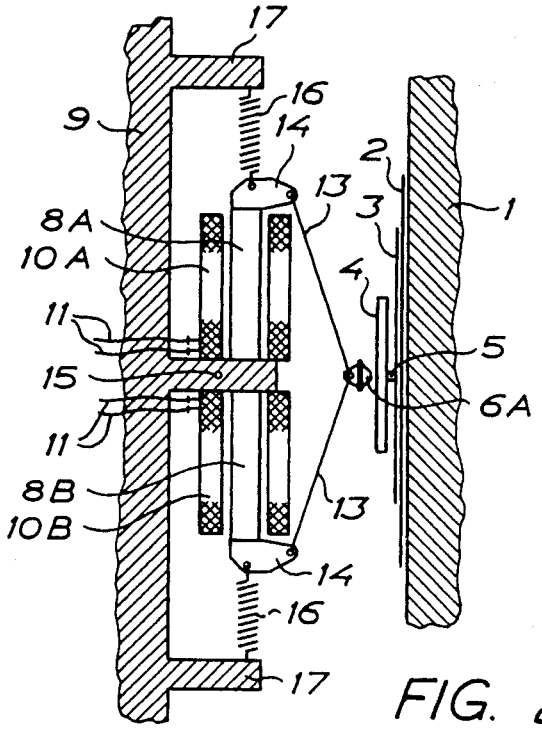

FIG. 2 very diagrammatically illustrates a printer device of printer hammer-type in which the motion generator unit primarily acts in a direction perpendicular to the striking direction, but wherein this movement is transmitted into an enlarged striking movement in the striking direction.

Figure 3:
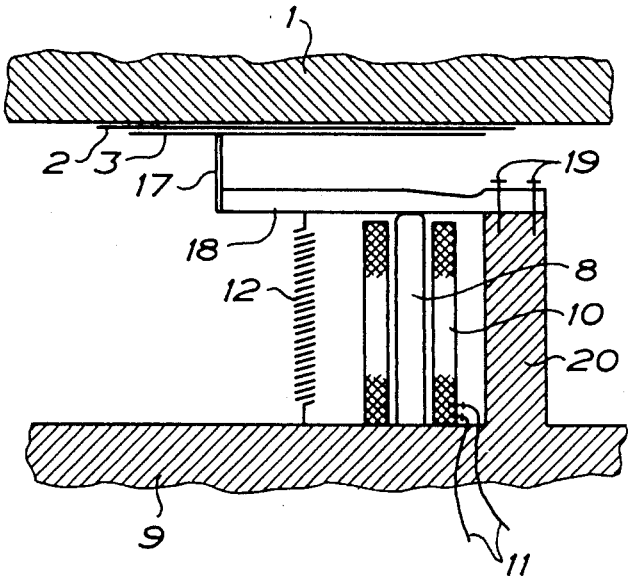

FIG. 3 very diagrammatically illustrates an embodiment of the invention in a printer of the needle-printer type.

The device diagrammatically shown in FIG. 1 includes an abutment 1, e.g. a type-writer roll or a support for a paper 2 in a printer which shall be provided with printed signs in the machine. Even if the paper 2 for the sake of clarity in the figure has been indicated to have a small gap between paper and the abutment 1, it should be evident that the paper 2 closely bears against the abutment 1. Positioned in front of the paper is an ink ribbon 3, and disposed in front of the ink ribbon is a printing wheels or a rotatable disc which is provided with signs 5 on the surface thereof facing the ink ribbon 3 and the paper 2. Further disposed in front of the printing wheel is a printer hammer, said printer hammer when striking against the printing wheel just in front of a sign, transmitting a printed picture of the sign 5 on the paper 2 due to striking action via the ink ribbon 3. The movement and rotation of the printing wheel 4 for aligning a desired sign just in front of the printer hammer 6 is obtained, as previously known, by means of control and driving means, not shown in the figure. For making the printer hammer 6 to strike against the printing wheel and thus to transmit a printed picture of the sign to the paper the printer hammer will have to move in a direction towards the printing wheel. To achieve this the printer hammer of the design shown in FIG. 1 is mounted at the end of a motion generator unit 8 in the form of a rod and consisting of a giant magnetostrictive material, e.g. a material which undergoes changes in dimension under the influence of a magnetic field. At the opposite end the motion generator unit 8 is fixed in a supporting structure 9, which may consist of a part included in the frame of the machine. The motion generator unit 8 is surrounded by a solenoid 10, which by means of lines 11 may be attached to a source of electric current including control means, not shown in the figure. The giant magnetostrictive material used in the motion generator unit 8 according to FIG. 1 is assumed to be of the kind which undergoes an increase in length under the influence of a magnetic field. Mounted at the free end of the motion generator unit is a yoke 7 which by means of tension springs 12 disposed on opposite sides of the motion generator unit 8 is subject to a substantially constant traction force in a direction towards the supporting structure 9, thereby preloading the motion generator unit 8 with an essentially constant compression force. The reason of this pre-stressing will be explained in more detail later.

When current is supplied to the magnetic windings 10 a magnetic field is applied to the motion generator unit resulting in that said motion generator unit will undergo a change in length so that the printer hammer 6 is made to strike against the printing wheel 4 just in front of a positioned sign 5 which due to this is transferred in the form of a printed picture to the paper 2.

A basic specific feature of the present invention is that the motion generator unit 8 is made of so called giant magnetostrictive material, i.e. an alloy between rare earth metals such as samarium (Sm), terbium (Tb), dysprosium (Dy), holmium (Ho), erbium (Er), tulium (Tm) and magnetic transition metals such as iron (Fe), cobalt (Co) and nickel (Ni). This group of alloys presents the largest magnetostriction known so far, i.e. possessing the property to undergo a change in dimension under the influence of magnetic field, said change in dimension being proportional to the intensity of the magnetic field. The magnitude of the magnetostriction in these materials is of a different range than is the case in ordinary magnetostrictive materials, e.g. iron-nickel. As an example it may be mentioned that iron-nickel has a change in length of 2–30 $\mu$m/m whereas an alloy of e.g. terbium-dysposium-iron has a change in length of 1700 $\mu$m/m. The change in length to which said giant magnetostrictive materials are subject under the influence of a magnetic field may be positive or negative, i.e.

may for certain of said compositions result in an increase in length and for other of said compositions result in a decrease in length. Both types of giant magnetostrictive materials may be used when practicing the present invention. Within the group of giant magnetostrictive materials the magnitude of the magnetostriction under the influence of a certain magnetic field varies, and when practicing the present invention it is of course preferred to use giant magnetostrictive materials having the largest magnetostrictive properties.

In order to obtain satisfactory results in use the motion generator unit of magnetostrictive material should be prestressed in a direction opposite to the direction of movement. Due to the prestressing mechanical hysteres in the magnetostrictive material is counteracted. The amount of prestressing needed is different for different kinds of magnetostrictive materials. As an example it should be mentioned that for an alloy between terbium, dysposium and iron in the relation $Tb_{0,27}$ $Dy_{0,73}$ $Fe_{1,95}$, the prestress together with the load should amount to 12 MPa. Magnetostrictive materials of the kind which undergoes an increase in length under the influence of the magnetic field should be prestressed by a compressive stress, whereas magnetostrictive materials which decrease in length under the influence of the magnetic field should be prestressed by a tensile stress. The prestress can be provided by means of a mechanical spring having suitable characteristics, as illustrated diagrammatically in FIG. 1 in which the springs 12 are disposed so that they will give rise to a compression stress in the motion generator unit 8.

When current is supplied to the magnetic coil 10 a magnetic field is generated in the coil, the axial direction of the magnetic field being parallel to the intended direction of movement of the motion generator unit 8. The magnetic field thus gives rise to a change in dimension of the motion generator unit consisting of giant magnetostrictive material. Since the motion generator unit 8 in the design shown in FIG. 1 is supposed to be made of the giant magnetostrive material of the kind that undergoes an increase in dimension under the influence of a magnetic field, the length of the motion generator unit 8 is increased resulting in that said unit is made to move the printer hammer 6 in the striking direction for striking against the printing wheel 4 and the sign 5 positioned on said wheel. By controlling the supply of current to the coil 10 by means of a control means not shown in the figure, the change of length of the motion generator unit can be carefully controlled and adapted to the predetermined distance present between the printer hammer 6, the printing wheel 4 including the sign 5 and the ink ribbon 3, the paper 2 and the abutment 1. It should be pointed out that the change in length of the motion generator unit 8 under the influence of a magnetic field takes place under minimal influence of inertial forces etc., which renders possible a very fast, steepless and exact control of the striking action exerted by the printer hammer 6 against the printing wheel. The striking movement of the printer hammer 6 is effected by means of a minimum of moveable parts, which to a very high extent contributes to decrease disturbing noice in the form of mechanical clatter. The very precise control of the striking movement which is rendered possible according to the present invention also contributes to decrease the noice generated at the striking action itself, since the striking force may be exactly adapted to the least possible striking force which provides an acceptable print of the sign on the paper. Still another advantage obtained is that the printing speed can be increased to a considerable extent thanks to the fact that the changes in dimension of the giant magnetostrictive material takes place very fast and, as mentioned, under a minimum of influence of inertial forces etc. An increase of the striking frequency of the printer hammer in the magnitude of ten times compared to known constructions thus seems to be possible.

FIG. 2 very diagrammatically illustrates an embodiment according to the invention in which the motion generator unit 8A, 8B extends perpendicularly with respect to the striking direction of the printer hammer 6A and in which the movement of the motion generator unit 8A, 8B is transmitted by means of two links 13, so that the movement is changed into an enlarged striking movement in the striking direction. A condition of the embodiment illustrated in FIG. 2 is that the motion generator unit 8A, 8B consists of a magnetostrictive material of the kind which undergoes a decrease in length under influence of a magnetic field. The arrangement including the printing wheel 4, the sign 5, the ink ribbon 3, the paper 2 and the abutment 1 corresponds to the embodiment shown in FIG. 1. As appears in FIG. 2 the motion generator unit consists of two parts 8A and 8B, which are attached to an attachment lug 15 which protrudes perpendicularly from the supporting structure 9. At those free ends the motion generator unit parts 8A and 8B are provided with a protruding fitting 14 in which the end of links 13 are articulately fixed. The opposite ends of links 13 are articulately attached to the printer hammer 6A. The desired prestressing of the movement generating members 8A, 8B is provided by means of tension springs 16, each being attached partly in the respective fitting 14 and partly in a portion 17 protruding from the supporting structure 9. When a magnetic field is applied to the motion generator unit 8A, 8B, said elements will be subject to a decrease in length, and by means of the links 13 this decrease in length will be changed into an enlarged striking movement of the printer hammer 6A in the striking direction.

FIG. 3 very diagrammatically illustrates an embodiment according to the invention in a printer of the needle printer type, i.e. a printer including a number closely spaced and in parallel with each other arranged needle-shaped striking members, arranged in one or several rows or in a checker pattern. Each needle-shaped striking member is provided with a motion generator unit by means of which the needle-shaped striking member can be forced to strike against a paper via an ink ribbon, so that a dot-shaped print is obtained on the paper, said dot-shaped print together with adjacent dot-shaped prints forms the intended sign, e.g. a letter, a figure etc. FIG. 3 diagrammatically illustrates the mechanism for moving one of the needle-shaped striking members 17 with respect to details in FIG. 3 corresponding to or identical with details in the embodiment previously described are referred to using the same reference numerals.

The device thus comprises an abutment 1, e.g. a support in a printer for a paper 2 which shall be provided with printed signs in the machine. Reference numeral 3 refers to an ink ribbon disposed in front of the paper. Arranged in front of the ink ribbon is a printer head including several needle-shaped striking members 17 arranged side by side in one or several rows or in a checker pattern. The needle-shaped striking member 17 is rigidly attached at the end of an arm 18 extending substantially in parallel with the abutment 1, the opposite end of said arm being attached to a rigid bracket 20 protruding from a supporting structure 9, said bracket forming part of the supporting structure 9. Extending between the underside of arm 18 and supporting structure 9 is a motion generator unit in the form of a rod 8 of giant magnetostrictive material of the kind that undergoes a change in length, in the illustrated embodiment an increase in length, under the influence of a magnetic field. The end of rod 8 is attached to the supporting structure 9 and the free end of the rod abuts the under side of arm 18. Rod 8 is surrounded by a magnetic coil 10 which by means of lines 11 may be connected to a source of electric current including control means not shown in the figure. The prestressing of the giant magnetostrictive rod 8 is provided by a tension spring 12 by means of which the arm 18 is pressed against the end of rod 8 with an essentially constant force. As mentioned previously a number of needle-shaped striking elements including appendant motion generator units are arranged side by side in one or several rows or in a checker pattern. By individually controlling the current supply to the magnet coils of the motion generator units an optional combination of needle-shaped striking elements can be forced to strike against the paper 2 via the ink ribbon 3 and thus leaving an individual print on the paper, and by relative parallel displacement of the abutment and the supporting structure 9 including the printer head a sequence of optional signs can be printed side by side of the paper 2. In the embodiment illustrated in FIG. 3 arm 18 forms a single armed lever by means of which the change in length to which the giant magnetostrictive rod 8 is subject can be exchanged, so that an enlarged displacement of the needle-shaped striking element 17 is obtained.

A very important advantage obtained from the device according to the invention is that not only the striking force but also the velocity sequence during the striking movement can be controlled continuously and with great precision, e.g. so that the striking element very fast is carried forward to immediate vicinity of the ribbon ink and the paper, after which the direct striking operation is carried out in a soft and at the same time exact manner resulting in that noice generated from the striking operation decreases to a considerable extent. By controlling the magnetic field of the motion generator unit the velocity sequence may be brought to follow any desired pattern.

The embodiment illustrated in FIGS. 1–3 are, as previously mentioned, extremely diagrammatic and only intended to illustrate the principle design of the device according to the invention. Dimensions, proportions, constructive details for using the invention for inclusion into a certain printer should be possible to decide upon by the man skilled in the art considering the embodiments described above.

The invention is thus not limited to the embodiments illustrated and described above but can be subject to changes within the scope of the appended claims. It is thus possible for instance to insert in the abutment 1, in front of the printer hammer, an element of magnetostrictive material and a coil, resulting in that said element, when current is supplied to its magnetic coil simultaneously with the supply of current to the magnetic coil of the motion generator unit, will give rise to a movement in a direction opposite to the striking direction of the portion of the abutment 1 formed by said element, so that the paper 2 will be lifted in a direction towards the printer hammer 6. The supporting structure 9 carrying the motion generator element 8 can form a part of the machinery frame, but alternatively may consist of a component movable in the frame, e.g. a carriage or some other movable component.

I claim:

1. In an impact printer device having, a striking member, an abutment supporting a paper thereon, an ink ribbon disposed between said striking member and said paper supporting abutment, said striking member by striking action transmitting a print to said paper via said ink ribbon, at least one motion generator unit comprising a rod of a giant magnetostrictive material consisting of an alloy of rare earth metals and one of the substances iron, cobalt and nickel, a supporting structure fixedly supporting one end of said rod, the opposite end of said rod being fixed to said striking member, a magnet coil surrounding said motion generator unit, a source of electric current, the improvement comprising means for reducing the noise generated from said printer, said noise reducing means including control means for first supplying an electric current to said magnetic coil to bring said striking member in close proximity to said paper, striking means for driving said striking member toward said paper and ink ribbon at a reduced speed less than that used in reaching said close proximity, after said control means has brought said striking member into said close proximity.

2. Device as claimed in claim 1, characterized in that the motion generator unit includes a giant magnetostrictive material of the kind which undergoes an increase in length under the influence of a magnetic field.

3. Device as claimed in claim 1, characterized in that the motion generator unit consists of a giant magnetostrictive material of the kind which undergoes a decrease in length under the influence of a magnetic field.

4. Device as claimed in claim 1, characterized in that the motion generator unit is pre-loaded in a direction opposite to the direction of the change in length caused by the magnetic field.

5. In an impact printer device having, a striking member, an abutment supporting a paper thereon, an ink ribbon disposed between said striking member and said paper supporting abutment, said striking member by striking action transmitting a print to said paper via said ink ribbon, at least one motion generator unit comprising a rod of a giant magnetostricive material consisting of an alloy of rare earth metals and one of the substances iron, cobalt and nickel, a supporting structure fixedly supporting one end of said rod, the opposite end of said rod being fixed to said striking member, a magnet coil surrounding said motion generator unit, a source of electric current, the improvement comprising means for reducing the noise generated from said printer, said noise reducing means including control means for first supplying an electric current to said magnetic coil to bring said striking member in close proximity to said paper, and then driving at reduced speed said striking member toward said paper and ink ribbon, after said control means has brought said striking member into close proximity, to strike against said paper and ink ribbon.

* * * * *

UNITED STATES PATENT AND TRADEMARK OFFICE

CERTIFICATE OF CORRECTION

PATENT NO. : 4,944,222

DATED : 31 July 1990

INVENTOR(S) : CARL H. TYREN

It is certified that error appears in the above-identified patent and that said Letters Patent is hereby corrected as shown below:

Column 1, line 3, delete "085,693" and insert --058,693--.

Column 2, line 4, delete "sheels" and insert -wheel--.

Signed and Sealed this

Fourth Day of June, 1991

*Attest:*

HARRY F. MANBECK, JR.

*Attesting Officer*

*Commissioner of Patents and Trademarks*